US009139486B2

(12) United States Patent
Von Wickede et al.

(10) Patent No.: US 9,139,486 B2
(45) Date of Patent: Sep. 22, 2015

(54) METHOD AND DEVICE FOR DECOMMISSIONING BODIES CONTAINING EXPLOSIVE MATERIAL

(75) Inventors: Gert Von Wickede, Dresden (DE); Ernst Kschamer, Burg (DE); Gerd Gude, Radibor (DE); Frank Petzsch, Kreba-Neudorf (DE)

(73) Assignee: SPREEWERK LUEBBEN GMBH, Luebben (DE)

( * ) Notice: Subject to any disclaimer, the term of this patent is extended or adjusted under 35 U.S.C. 154(b) by 603 days.

(21) Appl. No.: 13/356,080

(22) Filed: Jan. 23, 2012

(65) Prior Publication Data

US 2015/0239791 A1 Aug. 27, 2015

(30) Foreign Application Priority Data

Jan. 24, 2011 (DE) ..... 10 2011 003 072

(51) Int. Cl.
*C06B 21/00* (2006.01)

(52) U.S. Cl.
CPC ..... *C06B 21/00* (2013.01)

(58) Field of Classification Search
CPC ..... C06B 21/00; C06B 21/091
USPC ..... 149/108.2, 109.6, 124
See application file for complete search history.

(56) References Cited

U.S. PATENT DOCUMENTS

| | | | | |
|---|---|---|---|---|
| 4,773,298 | A | 9/1988 | Tischer et al. | |
| 5,974,937 | A | 11/1999 | Doughty et al. | |
| 6,476,286 | B1 * | 11/2002 | Taylor et al. | 149/108.2 |
| 6,777,586 | B1 * | 8/2004 | Arcuri et al. | 149/109.6 |
| 2003/0111148 | A1 * | 6/2003 | Warner et al. | 149/74 |

FOREIGN PATENT DOCUMENTS

| | | | |
|---|---|---|---|
| DE | 35 42 787 | A1 | 6/1987 |
| DE | 41 40 001 | C1 | 2/1993 |
| DE | 42 21 666 | C1 | 1/1994 |
| DE | 196 14 391 | A1 | 10/1997 |
| DE | 197 29 483 | A1 | 1/1999 |
| DE | 197 36 298 | B4 | 2/1999 |
| DE | 199 14 688 | C2 | 10/1999 |
| DE | 101 29 016 | A1 | 12/2002 |
| DE | 202 15 938 | U1 | 3/2003 |
| DE | 102 45 512 | B3 | 2/2004 |
| DE | 102 51 105 | A1 | 5/2004 |
| DE | 2005 018 476 | B4 | 10/2006 |
| DE | 10 2008 026 242 | B4 | 12/2009 |
| GB | 2330801 | | 5/1999 |
| WO | WO 99/28700 | | 6/1999 |
| WO | WO 99/34165 | | 7/1999 |

OTHER PUBLICATIONS

Elie et al., "Cryofracture Demilitarization Program Update," 2003 Global Demilitarization Symposium & Exhibition, May 20, 2003.

* cited by examiner

*Primary Examiner* — Aileen B Felton
(74) *Attorney, Agent, or Firm* — Greenblum & Bernstein, P.L.C.

(57) ABSTRACT

Method for decommissioning a body containing explosive material includes opening the body containing explosive material in a secured and/or currentless state, and cutting individual bodies along a cutting plane into at least two parts in a liquid by one or more cutting processes to expose the main charge carriers intact in the respective individual bodies for removal without destruction. Method further includes removing main charge carrier essentially intact while still in the liquid from the individual bodies, and transferring the main charge carrier to a container, structured and arranged to store each individual main charge carrier free from contact with other main charge carriers, and which includes a material that is absorbent for liquids. Method further includes feeding the container with the main charge carriers to an incineration process and grinding all of the other parts of the individual bodies in a grinding process to produce ground material.

14 Claims, No Drawings

METHOD AND DEVICE FOR DECOMMISSIONING BODIES CONTAINING EXPLOSIVE MATERIAL

CROSS-REFERENCE TO RELATED APPLICATIONS

The present application claims priority under 35 U.S.C. §119(a) of German Patent Application No. 10 2011 003 072.7, filed Jan. 24, 2011, the disclosure of which is expressly incorporated by reference herein in its entirety.

BACKGROUND OF THE INVENTION

1. Field of the Invention

The invention relates to the fields of process engineering and explosives technology and relates to a method and a device for decommissioning bodies containing explosive material, such as, for example, ammunition, bombs or grenades that contain land mines, and from which the explosive materials can be removed and rendered harmless.

2. Discussion of Background Information

Decommissioning is understood as dismantling ammunition or other bodies containing explosive material into their functional and/or material components for the purpose of demolition here in the sense of disposal. Intermediate products produced thereby can continue to be dangerous up until final disposal according to their material properties.

With the known methods for unloading explosive materials from their casings, in particular from military objects, the casings of the objects are first opened so that the explosive material is openly accessible. The opening of the casings of the objects is either already structurally provided or it usually takes place at the detonator housing or the feed opening.

Subsequently, in many cases the explosives are melted out, if they themselves are meltable or contain meltable components.

A method is known for opening bodies containing explosive material for environmentally safe disposal of ammunition, in which the bullet case is slit tangentially up to a residual wall thickness by a compressed water jet with integrated abrasive particles (DE 42 21 666 C1). The ammunition is then separated by the application of bending and/or torsional forces. The ammunition then breaks into two parts at the predetermined breaking point stipulated by the residual wall thickness.

Various other methods for decommissioning ammunition or grenades are likewise known (WO 99/34 165; DE 197 36 298 A1; DE 102 45 512 B3; DE 102 51 105 A1; DE 41 40 001 C1; WO 99/28700; DE 202 15 938 U1).

A method is likewise known for removing an explosive charge from hollow-charge ammunition (DE 199 14 688 C2). Accordingly, a hollow punch die is guided through the open end of the jacket of the ammunition and into the explosive material and subsequently the explosive material is released by a vacuum.

A disadvantage of all of these methods is the complicated process engineering, for example, the complex supply and removal of water with the abrasive particles and the necessary precise control of the process, in particular with respect to the dimensions of the water jet and its guidance during the cutting operation. Likewise, the insertion of a hollow punch die into the ammunition and the explosive material is possible only under special safety conditions and additional devices are necessary for application of a vacuum.

Furthermore, a method and a device are known for removing explosive materials (DE 101 29 016 A1). Accordingly, the casing is respectively opened in the region of the largest cross section of the geometry of the interior of the casing. This can be carried out as is known by separating, cutting, sawing or breaking. Subsequently, the explosive material that is completely or partially meltable is heated in the contact region with the casing so that it is detached from the casing and can be removed into a separate vessel.

A disadvantage here is that a high expenditure in terms of time and energy is necessary for removing the explosive material.

Various disposal concepts are currently known for decommissioning land mines. These are in particular destruction by detonation or the very questionable disposal by offshore dumping.

An offshore dumping of live ammunition is prohibited not only for environmental reasons; against the background of influence of seawater (corrosion), the explosive materials are also latently dangerous for future generations of humans as well as animal and plant populations. Known cases from the era during and after World War II are currently causing enormous problems, e.g., in the Baltic with regard to disposal.

For destruction by detonation a device is known from DE 10 2008 026 242 A1 for the destruction of land mines. This device is composed of a ramp rising obliquely, which forms a guide path for a barrel weight. The barrel weight is connected to a trigger device, which is triggered by the barrel weight running down the ramp. This trigger device in turn triggers the detonator of the land mine so that it is destroyed.

Likewise, according to DE 10 2005 018 476 A1 a device is known for destroying land mines. Accordingly, a hammer pad which has a plurality of hammers is used. The hammers are shaped such that they cannot slip out of the hammer pad. This hammer pad is then lifted by an armored vehicle and placed on the ground where land mines are suspected. When a landmine is hit by the hammer pad, it is detonated and thus destroyed.

Another method and a device for removing land mines is known from DE 197 29 483 A1. Accordingly, the land mines are detected by an aircraft and localized and destroyed by a targeted shot.

According to the methods that are known from DE 196 14 391 A1 and DE 35 42 787 A1, land mines are essentially detonated by autogenous cutting torches or focused laser beams and destroyed thereby.

Furthermore, a method is known for destroying land mines (Global Demilitarization Symposium & Exhibition in Sparks, Nev. USA in May 2003). Accordingly, the mines are supercooled with liquid nitrogen, the main charge carrier is removed and then the energy components are fed to an incineration.

All of these known methods have in common that the land mines are destroyed and in particular no components can be recycled. Furthermore, however, the quantitative and qualitatively complete destruction of all mines in a ground region is not ensured in every case with these methods.

SUMMARY OF EMBODIMENTS OF THE INVENTION

The aim of the present invention is to disclose a method and a device for decommissioning bodies containing explosive materials, in particular land mines, in which a secure destruction of all explosive materials of the bodies containing explosive materials is carried out and at the same time components of the body containing explosive materials can be recycled.

The aim is attained by the invention disclosed in the claims. Advantageous embodiments are the subject matter of the subordinate claims.

Embodiments of the present invention are directed to a method for decommissioning a body containing explosive material, wherein the body containing explosive material one of is an individual body containing explosive material and contains one or more individual bodies containing explosive material, and wherein each respective individual body comprises one or more main charge carriers and other parts. The method comprises opening the body containing explosive material in at least one of a secured and currentless state, and cutting one or more of the individual bodies in a liquid along a cutting plane into at least two parts by one or more cutting processes to expose the one or more main charge carriers intact in the one or more respective individual bodies containing explosive material for removal without destruction. The method further includes removing the one or more main charge carriers essentially intact while still in the liquid from the individual bodies containing explosive material, and transferring the one or more main charge carriers to a container, which is structured and arranged to store each individual main charge carrier free from contact with other main charge carriers, and which comprises a material that is absorbent for liquids. The method additionally includes feeding the container with the one or more main charge carriers to an incineration process, grinding all of the other parts of the individual bodies containing explosive material in a grinding process to produce ground material, wherein the grinding process is carried out in the presence of at least one of liquid and moisture, and screening off and removing the ground material with a screen mesh, wherein a width of the screen mesh has a maximum size that is less than a volume dimension of a smallest volume of assemblies containing the explosive material in the one or more individual bodies.

In embodiments, the body containing explosive material comprises a grenade, and the one or more individual bodies containing explosive material comprise land mines In further embodiments, the land mines comprise one of M72 Area Denial Anti-Personnel Mine (ADAM) and M67 ADAM.

In additional embodiments, the opening of the body containing explosive material is carried out in a reverse order of assembling the body, and wherein the at least one of the secured and currentless state is realized in a secured manner.

In yet further embodiments, the cutting process is realized under water.

In embodiments, a plurality of the individual bodies are subjected to the cutting process at a same time, and wherein the cutting plane is selected such that the main charge carrier in an interior of the individual bodies remains intact.

In further embodiments, the container comprises partitions structured and arranged to secure a contact-free storage of each individual main charge carrier from other main charge carriers in the container.

In additional embodiments, the incineration process comprises inserting one or more containers into an armored incineration furnace, and heating the one or more containers until detonation and incineration of all combustible components of the main charge carriers.

In yet further embodiments, the grinding process at least one of is carried out in the presence of water or water vapor and includes water sprayed in or dropped in.

In embodiments, the grinding process comprises using contaminated liquid from the cutting processes.

In further embodiments, the grinding process is carried out in one of a hammer mill and a ball mill.

In additional embodiments, the screening off and removing the ground material with the screen mesh comprises allowing ground material that is not yet sufficiently fine to remain in the grinding process, and one of dumping the discharged ground material at a landfill and feeding the discharged ground material to a recycling process.

In yet further embodiments, the screen mesh width is ≤2 mm when decommissioning individual bodies containing explosive material mines M72 Area Denial Anti-Personnel Mine (ADAM) or M67 ADAM.

Embodiments of the present invention are directed to a device for decommissioning bodies containing explosive material, wherein a body containing explosive material one of is an individual body containing explosive material and contains one or more individual bodies containing explosive material, and wherein a respective individual body comprises one or more main charges and other parts. The device comprises an opening device structured and arranged for opening the bodies containing explosive material, in at least one of a secured and currentless state, and a cutting device structured and arranged for a cutting operation in a liquid comprising at least one of cutting and cutting open the one or more individual bodies. The device further comprises a removing device structured and arranged for removing one or more main charge carriers from the one or more individual bodies, and a grinding device structured and arranged for grinding the other parts in the presence of at least one of liquid and moisture. The device additionally includes a limiting device structured and arranged for limiting discharged particles from the grinding device.

In embodiments, the cutting device comprises one or more knives structured and arranged to essentially smoothly cut through a housing of the individual bodies lying in a cutting plane.

In further embodiments, the cutting device is located outside the liquid and the cutting operation is realized in the liquid.

In additional embodiments, the device further comprises a fixture element structured and arranged for transferring the one or more main charge carriers out of the liquid and into a container. The removing device comprises a ram, which is connected to the cutting device, and which is structured and arranged for pressing the one or more main charge carriers into the fixture element.

In yet further embodiments, the grinding device comprises one of a hammer mill and a ball mill.

In embodiments, the grinding device is structured and arranged to grind in the presence of one of water and water vapor, and comprises a system for spraying or dropping water during the grinding.

In further embodiments, the limiting device comprises one or more screens.

In additional embodiments, the grinding device comprises a grinding housing, and the one or more screens are arranged in a lower region of the grinding housing.

With the method according to the invention for decommissioning bodies containing explosive material, a body containing explosive material is opened in the secured and/or currentless state, wherein this body containing explosive material itself is the individual body containing explosive material or contains one or more individual bodies containing explosive material. One or more of the individual bodies containing explosive material are cut into at least two parts in a liquid by cutting processes, wherein the selection of the cutting planes exposes the main charge carrier undamaged in the body containing explosive material for removal without destruction. The main charge carrier or carriers essentially undamaged still in the liquid are removed from the individual bodies containing explosive material cut open or cut up and are transferred to a container, which stores each individual main charge carrier free from contact with other main charge carriers, and furthermore contains a material that is absorbent for liquids or is composed thereof and subsequently the main charge carriers with the container are fed to an incineration process. Furthermore, all of the other parts of the individual bodies containing explosive material and cut open or cut up are subjected to a grinding process, wherein the grinding process is carried out in the presence of liquid and/or moisture. Subsequently, the ground material is screened off and removed, wherein the screen mesh width has a maximum size that is below the volume dimensions of the smallest volume of assemblies containing explosive material in the individual body.

Advantageously, a body containing explosive material in the form of a grenade is decommissioned, which contains one or more individual bodies containing explosive material, advantageously in the form of land mines Furthermore advantageously, mines M72 ADAM or M67 ADAM are decommissioned as individual bodies containing explosive material.

Likewise advantageously, the opening of the body containing explosive material is carried out in the reverse order of assembling the body, wherein the secured and/or currentless state is realized in a secured manner.

And also advantageously the cutting process is realized under water, wherein advantageously several individual bodies are subjected to the cutting process at the same time, and wherein the intactness of the main charge carrier in the interior of the individual body is realized by the at least one cutting plane.

It is also advantageous if the main charge carrier is removed intact under water from the individual bodies cut and/or cut open, and transferred into a container, wherein the container is provided with partitions, which secure the contact-free storage of each individual main charge carrier from the other main charge carriers in the container.

It is furthermore advantageous if the main charge carriers stored in one or more containers are inserted into an armored incineration furnace, heated until detonation, and all combustible components of the main charge carriers are incinerated.

It is likewise advantageous if the individual bodies containing explosive material are subjected to a grinding process without the main charge carriers, which is carried out in the presence of water or water vapor or water sprayed in or dropped in. Furthermore, contaminated liquid from the cutting process can advantageously be used.

And it is also advantageous if the grinding process is carried out in a hammer mill or a ball mill.

It is also advantageous if the ground material is guided through one or more screens, wherein not enough fine ground material remains in the grinding process and the discharged ground material is dumped at a landfill or fed to a recycling process.

And it is also an advantage if screens with mesh widths of ≤2 mm are used in the case of decommissioning individual bodies containing explosive material mines M72 ADAM or M67 ADAM.

The device according to the invention for decommissioning bodies containing explosive material is composed of a device for opening the bodies containing explosive material, which itself is an individual body containing explosive material or contains one or more individual bodies containing explosive material, in the secured and/or currentless state, and a device for cutting or cutting open the individual bodies containing explosive material, which realizes the cutting operation in a liquid, and a device for removing the main charge carriers from the individual bodies containing explosive material, and a device for grinding the other parts cut and/or cut open of the individual bodies containing explosive material in the presence of liquid and/or moisture, and a device for limiting the discharged particles from the grinding operation.

Advantageously, the cutting takes place by the device for cutting and/or cutting open the individual bodies containing explosive material by one or more knives, which realize an essentially smooth cut through the housing of the individual bodies and all of the installations lying in the cutting plane.

Likewise advantageously, the device for cutting and/or cutting open during the insertion of the individual bodies containing explosive material is located outside the liquid and the cutting operation is realized in the liquid.

Furthermore advantageously, the device for removing the main charge carriers is a ram, which is connected to the device for cutting and/or cutting open, and which presses the main charge carriers into a fixture element, which transfers the main charge carriers out of the liquid and into a container.

And also advantageously the device for grinding the other parts of the individual bodies containing explosive material without the main charge carriers is a hammer mill or a ball mill in which at least during the grinding operation liquid and/or moisture is located, advantageously in the form of water and/or water vapor and/or water sprayed in or dropped in.

It is furthermore advantageous if the device for limiting the discharged particles of the grinding operation is one or more screens which advantageously are arranged in the lower region of the grinding housing.

DETAILED DESCRIPTION OF EMBODIMENTS OF THE INVENTION

With the solution according to the invention it is possible for the first time to decommission bodies containing explosive material, in particular which contain individual bodies containing explosive material, and to feed the materials of which to a landfill or a recycling.

The bodies containing explosive material, for example, ammunition or a bomb or a grenade, which themselves are individual bodies containing explosive material or contain individual bodies containing explosive material, such as one or more land mines, are thereby opened. This takes place in the reverse order to assembly, wherein the secured and/or currentless state is realized in a secured manner. The detonator mechanism must not be activated during this opening of the body.

After the opening, the individual bodies containing explosive material are removed and fed to a cutting process. In the cutting process it is important that the cutting planes are embodied such that the main charge carrier or carriers in the individual bodies on the one hand are exposed such that they can be removed essentially intact from the individual body, and on the other hand the main charge carrier also remains essentially intact. To this end the respective individual bodies are examined before the first cutting operation to establish where the cutting planes must be located so that the demands are met. Thereafter, the control of the cutting tool is adjusted accordingly so that the individual elements are always identically positioned in a special guide on the cutting device, so that then the same cutting planes are always realized on each identical individual element. The cutting operation is advantageously realized with one or more knives and the knives produce an essentially smooth cut through the housing and the optionally present installations of the individual body. It is particularly important thereby that the cutting operation is carried out in each case in a liquid. At least the entire individual body must thereby be immersed in the liquid. Through the presence of the liquid, which advantageously is water, any dust or fragments harmful to the environment or to health occurring are retained in the water.

After the individual body is cut and/or is cut open, the main charge carrier or carriers are removed from the individual bodies. This is carried out by a device, which advantageously is a component of the cutting device. In each case the removal of the main charge carriers must be carried out in a liquid, advantageously in water.

Advantageously, the device for removing the main charge carriers is a ram, which presses the main charge carrier out of the individual bodies cut and/or cut open. The ram presses the main charge carrier advantageously into a fixture element, which transfers the main charge carrier into a container. The fixture element is advantageously a metal body with a cutout essentially in the shape of the main charge carrier. For example, in the case of landmines, the main charge carrier is shaped in a spherical manner. The cutout in the fixture element can thus be a cylindrical opening. The main charge carrier is securely supported in the fixture element and can be guided out of the cutting device to the container by rotating the fixture element. The main charge carrier is then inserted into the container, wherein the container has partitions that render possible a contact-free storage of the main charge carriers from one another. In turn, in the case of landmines as individual bodies and spherical main charge carriers, these can be inserted into the egg cartons of the same or similar containers. The containers should be composed of a combustible material that burns in an environmentally safe manner, such as cardboard or paper, for example. Furthermore, they should be cost-effective and furthermore, due to their material or also due to additionally inserted material, should be able to absorb any liquids possibly present that could leak out of the main charge carrier. An additional material of this type could be sawdust or paper.

The main charge carriers are subsequently, if necessary even after storage, transferred to a furnace that can realize an incineration of all of the constituents, if possible. To this end, an armored furnace is necessary in the case of main charge carriers forming splinters of landmines, since these main charge carriers also contain metal parts. The main charge carriers located in the furnace in their containers are heated, brought to incineration or explosion, and subsequently, all combustible components are incinerated. After the incineration operation, the discharged material is composed on the one hand of recyclable metals, and on the other hand of landfillable waste.

All of the other components of the individual bodies containing explosive material are removed from the cutting device and fed to a grinding device. These remaining components can also still contain explosive materials, but not as a main charge. In the grinding device, which advantageously is a hammer mill or a ball mill, the constituents are comminuted until they are discharged via a device for limiting the particle size, advantageously one or more screens. The entire grinding operation thereby takes place with the use of a liquid and/or moisture. In turn, this can be advantageously water and/or water vapor, wherein the liquid and/or moisture is advantageously introduced into the grinding device, sprayed in and/or dropped in. The limitation in terms of time of the grinding operation is carried out by reaching the particle size that is determined by the maximum screen mesh width. The maximum screen mesh width must thereby be selected according to the invention such that it is smaller than the smallest volume element of assemblies containing explosive material in the constituents of the individual bodies introduced into the grinding device. It is ensured by grinding the constituents to particle sizes smaller than the smallest volume elements of assemblies containing explosive material that during the grinding operation all of the assemblies containing explosive material still present are subjected to the grinding operation, and thus, are mechanically stressed such that the explosive material contained is brought to explosion, so that in the ground material discharged from the grinding device no material with explosive material properties is present that could still explode.

The liquid and/or moisture present in the grinding device ensures that on the one hand dust harmful to the environment and/or health occurring is bound and on the other hand the explosive force of the explosive materials still present is damped and dust explosions and/or mill fires are prevented. Depending on the quantity known per se of explosive materials still present in the constituents that are fed to the grinding device, the grinding device must then be armored accordingly.

The moist ground material discharged from the grinding device can then be dumped at a landfill or fed to recycling.

The solution according to the invention is therefore an industrially applicable method for decommissioning bodies containing explosive material, in particular against the background of protecting the environment and health.

The method according to the invention and the device according to the invention can be used in particular advantageously for grenades containing land mines, wherein in the military field the land mines are known under the names M72 Area Denial Anti-Personnel Mine (ADAM) and M67 ADAM. In general, these land mines are referred to as bounding mines These mines are functionally designed as described below and have special features likewise described below.

However, grenades and land mines of this type can also be decommissioned with the solution according to the invention such that they can be essentially completely decommissioned and disposed of. The land mines contained in the grenade thereby form the individual bodies containing explosive material according to the invention.

Laying the landmines is usually carried out with the aid of artillery grenades. These can be filled with thirty-six land mines of this type. After firing, by detonating of the grenades over the target area, the base plate thereof is blasted off and the mines are ejected from the grenade. Upon impact on the ground, seven tripwires are ejected from each mine. The mines are thereby activated. The mines then detonate by the tripwires being touched or moved or depending on the presetting by self-destruction.

The mines are composed essentially of a wedge-shaped housing, which has plastics as the matrix material. Further fittings are present in the interior of the housing in addition to the spherical main charge carrier, which fittings serve to protect the function of the mine, such as further assemblies containing explosive material (detonator, igniter, gas generator), as well as electronic components and cables.

The main charge carrier is thrown out by detonating the mine. The main charge carrier is a metal ball, which is surrounded by a propellant charge in liquid form. This ball is thrown approximately 1.5 m upwards and explodes as a result of the triggering of the explosive charge in the interior of the metal ball. The explosive charge is composed of a highly sensitive and highly explosive material with the main content being hexogen.

Due to the explosion, the ball bursts into a large number of small splinters that represent the actual effect of the land mine In the production of the mine housing of these land mines, the plastic used as a matrix material is cured with a polymerization accelerator. Polyurethane is generally used as the plastic and uranyl acetyl acetonate as a polymerization accelerator, a salt that contains uranium in depleted form (U238). This salt has an extremely low radioactivity, but is very toxic.

Through the known methods for detonating the landmines or their thermal disposal both in open air or in closed installations, the environment and the installation technology are therefore contaminated with toxic uranium oxide dust as a combustion product. These disposal methods must therefore be carried out only under the strictest safety precautions.

Furthermore, the main charge carrier of these land mines contains a propellant charge in liquid form, a so-called "liquid propellant." The physiological properties of this material are similar to those of nitroglycerin. In addition to the explosive force, this substance has a vasodilating effect on people, and thus lowers the blood pressure. With long-term contact, this can lead to serious health problems.

Furthermore, the explosive of the explosive charge of the main charge carrier essentially contains the highly sensitive and highly explosive material hexogen. As is known, with dynamic and/or mechanical stress (partition and separation processes, such as pressing or cutting), this tends more to detonative conversion (explosion) than other explosives used in military ammunition.

With the method according to the invention and the device according to the invention, in particular these land mines can be decommissioned.

Through the solution according to the invention, during the decommissioning of bodies containing explosive material, no dust and in particular no toxic dust is released, the mechanical stress of the explosive of the main charge carrier is prevented, and the liquid propellant charge remains intact. Furthermore, the mine housing without the main charge carrier is comminuted by the mechanical stress in the grinding process, such that likewise no dust, in particular no dust containing uranium, can be released, and the explosive materials still contained therein are quantitatively completely converted and incinerated. There is no longer any risk of explosion after discharge of the ground material.

The discharged, moistly bound ground material can be disposed of in a landfill without any difficulty, or processed by corresponding treatment and/or recycling methods in order to recover the valuable substances in the ground material.

In addition to preventing the release of dust and the absorption of energy during the detonation of explosive materials, mill fires and/or dust explosions are prevented by the use of the liquid during the grinding process.

The invention is described in more detail below based on an exemplary embodiment.

Example 1

In a 155 mm M692 ADAM grenade as a body containing explosive material, thirty-six M67 (ADAM) mines as individual bodies containing explosive material are located, which are embodied in a wedge-shaped manner and respectively have a separately detonatable main charge carrier located in the mine housing. The mine housing is composed of an epoxide resin matrix in which electronic components and components containing explosive material for guaranteeing the mine function are embedded in addition to the main charge carrier. Uranyl acetyl acetonate was used as a polymerization accelerator for curing the epoxide resin during the production of the mine housing.

The grenade is opened in the secured and currentless state, wherein the ram located therein is not loaded. The charges located in the individual bodies are not activated and/or detonated thereby.

Six mines as individual bodies are inserted into a 6-fold cutting device. The insertion is carried out in a receptacle adapted to the mines. An always identical positioning of the individual bodies with respect to the blade is carried out thereby. The insertion of the mines is carried out outside of the liquid, which in this case is water. The cutting device itself is located in a container filled with water. After the positioning of the mines, the receptacle is lowered into the water and the cutting operation can be carried out. A part of the epoxide resin housing with the fittings located therein is cut off thereby by a metallic knife, wherein the cutting plane lies on the gable end of the mine and the cut runs tangentially past the main charge carrier. During the cutting process, all of the mine parts and the cutting tool itself are located under water. The cutting operation is carried out with security.

After the one end face of the mine has been cut off, the main charge carrier is pressed out of the opened housing from the other end face with a male die. The male die thereby pushes the main charge carrier into a female die, from which the main charge carrier falls into a collection screen.

This operation is also carried out under water and with security.

After the cutting operation has been carried out, all parts of the mine are lifted out of the water and the main charge carrier is transferred into a container which is composed of cardboard and contains separators which prevent direct contact among the main charge carriers with one another. In the present case, a commercially available egg carton made of cardboard is used.

The parts of the cut open mine housing are likewise removed from the cutting device and fed to a hammer mill. The fed quantity is coordinated with the variable rotor speed. 25 kg mine housing per hour is thus fed to the hammer mill, which runs at a speed of 1750 $min^{-1}$ The milling chamber is acted on with 30 l water/min. In the lower region of the hammer mill a screen is located with a mesh width of 2 mm. As soon as the parts of the ground material present in the hammer mill have fallen below the particle size of 2 mm, they fall through the screen.

The further explosive materials that were present in the mine housing (not in the main charge carrier) originally had individually larger edge lengths than 2 mm. It is ensured by the comminution to ≤2 mm that all of the explosive material volumes have been brought to detonation during grinding and the discharged ground material is then free from explosive material.

Due to the use of water in the hammer mill the decommissioning of the explosive materials in the mine housing takes place under secure conditions.

The ground material discharged free from explosive material is packed in a water moist manner and disposed of in a landfill.

The main charge carriers in the cardboard packaging are fed together to the thermal destruction plant. During the temperature increase, the propellant charge as well as the active charge in the main charge carrier are destroyed. The waste leaving the furnace is recycled.

The invention claimed is:

1. A method for decommissioning a body containing explosive material, wherein the body containing explosive material one of is an individual body containing explosive material and contains one or more individual bodies containing explosive material, and wherein each respective individual body comprises one or more main charge carriers and other parts, the method comprising:

opening the body containing explosive material in at least one of a secured and currentless state;

cutting at least one of the one or more individual bodies in a liquid along a cutting plane into at least two parts by one or more cutting processes to expose the one or more main charge carriers intact in the one or more individual bodies for removal without destruction;

removing the one or more main charge carriers essentially intact while still in the liquid from the individual bodies containing explosive material;

transferring the one or more main charge carriers to a container, which is structured and arranged to store each individual main charge carrier free from contact with other main charge carriers, and which comprises a material that is absorbent for liquids;

feeding the container with the one or more main charge carriers to an incineration process;

grinding all of the other parts of the individual bodies containing explosive material in a grinding process to produce ground material, wherein the grinding process is carried out in a presence of at least one of liquid and moisture; and screening off and removing the ground material with a screen mesh, wherein a width of the screen mesh has a maximum size that is less than a volume dimension of a smallest volume of assemblies containing the explosive material in the one or more individual bodies.

2. The method of claim 1, wherein the body containing explosive material comprises a grenade having one or more individual bodies containing explosive material.

3. The method of claim 2, wherein the individual bodies containing explosive material comprise one of M72 Area Denial Anti-Personnel Mine (ADAM) and M67 ADAM.

4. The method of claim 1, wherein the opening of the body containing explosive material is carried out in a reverse order of assembling the body, and wherein the at least one of the secured and currentless state is realized in a secured manner.

5. The method of claim 1, wherein the cutting process is realized under water.

6. The method of claim 1, wherein a plurality of the individual bodies are subjected to the cutting process at a same time, and wherein the cutting plane is selected such that the main charge carrier in an interior of the individual bodies remains intact.

7. The method of claim 1, wherein the container comprises partitions structured and arranged to secure a contact-free storage of each individual main charge carrier from other main charge carriers in the container.

8. The method of claim 1, wherein the incineration process comprises:

inserting one or more containers into an armored incineration furnace; and heating the one or more containers until detonation and incineration of all combustible components of the main charge carriers.

9. The method of claim 1, wherein the grinding process at least one is of carried out in the presence of water or water vapor and includes water sprayed in or dropped in.

10. The method of claim 1, wherein the grinding process comprises using contaminated liquid from the cutting processes.

11. The method of claim 1, wherein the grinding process is carried out in one of a hammer mill and a ball mill.

12. The method of claim 1, wherein the screening off and removing the ground material with the screen mesh comprises allowing ground material that is not yet sufficiently fine to remain in the grinding process, and one of dumping the discharged ground material at a landfill and feeding the discharged ground material to a recycling process.

13. The method of claim 1, wherein the screen mesh width is ≤2 mm when decommissioning individual bodies containing explosive material mines M72 Area Denial Anti-Personnel Mine (ADAM) or M67 ADAM.

14. The method of claim 1, further comprising selecting the cutting plane.

* * * * *